United States Patent [19]

Chibana

[11] 4,135,422

[45] Jan. 23, 1979

[54] ELECTRONIC MUSICAL INSTRUMENT

[75] Inventor: Masanobu Chibana, Hamamatsu, Japan

[73] Assignee: Nippon Gakki Seizo Kabushiki Kaisha, Hamamatsu, Japan

[21] Appl. No.: 766,595

[22] Filed: Feb. 8, 1977

[30] Foreign Application Priority Data

Feb. 12, 1976 [JP] Japan ..... 51/13242

[51] Int. Cl.[2] ..... G10H 5/00

[52] U.S. Cl. ..... 84/1.01; 364/721; 84/1.03

[58] Field of Search ..... 84/1.01, 1.03, 1.11, 84/1.12, 1.19, 1.20, 1.21, 1.22, 1.23; 364/603, 607, 721, 722, 857

[56] References Cited

U.S. PATENT DOCUMENTS

| | | | |
|---|---|---|---|
| 3,809,786 | 5/1974 | Deutsch | 84/1.01 |
| 3,809,788 | 5/1974 | Deutsch | 84/1.01 |
| 3,888,153 | 6/1975 | Deutsch | 84/1.03 |
| 3,992,970 | 11/1976 | Chibana | 84/1.03 |
| 3,992,971 | 11/1976 | Chibana | 84/1.03 |
| 3,994,195 | 11/1976 | Chibana | 84/1.03 |

*Primary Examiner*—Robert K. Schaefer
*Assistant Examiner*—William L. Feeney
*Attorney, Agent, or Firm*—Cushman, Darby & Cushman

[57] ABSTRACT

In an electronic musical instrument wherein waveshape F(x,y) is computed and the resultant waveshape is converted to a musical tone, computation of said waveshape F(x, y) is carried out in accordance with either one of the following equations:

$$F(x, y) = \frac{\sin\{f(x) + \frac{n-1}{2} f(y)\} \cdot \sin \frac{n}{2} f(y)}{\sin \frac{1}{2} f(y)}$$

$$F(x, y) = \frac{\cos\{f(x) + \frac{n-1}{2} f(y)\} \cdot \sin \frac{n}{2} f(y)}{\sin \frac{1}{2} f(y)}$$

wherein: f(x), f(y) represent mathematical functions of time, respectively; and n represents an arbitrary integer.

18 Claims, 15 Drawing Figures

KEY
10
12
14
$\omega_1$ MEMORY
16
$\omega_2$ MEMORY
18
ACC
20
ACC
$\omega_1 t = x$
$\omega_2 t = y$
22
24
26
28
Sin/Cos
30
32
Sin
34
36
38
Sin
40
42
D-A
44
46
OR
$\frac{\sin(\omega_1 + \frac{n-1}{2}\omega_2)t \cdot \sin\frac{n}{2}\omega_2 t}{\sin\frac{\omega_2}{2}t}$
$\frac{\cos(\omega_1 + \frac{n-1}{2}\omega_2)t \cdot \sin\frac{n}{2}\omega_2 t}{\sin\frac{\omega_2}{2}t}$
$\sin(\omega_1 + \frac{n-1}{2}\omega_2)t$
OR
$\cos(\omega_1 + \frac{n-1}{2}\omega_2)t$ FIG. 9
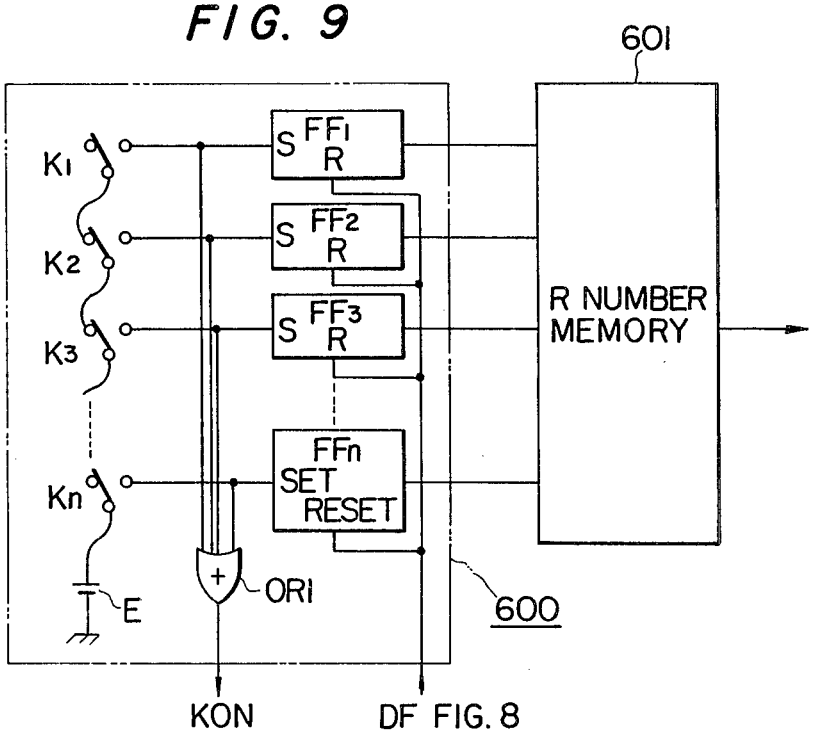
FIG. 8
FIG. 10
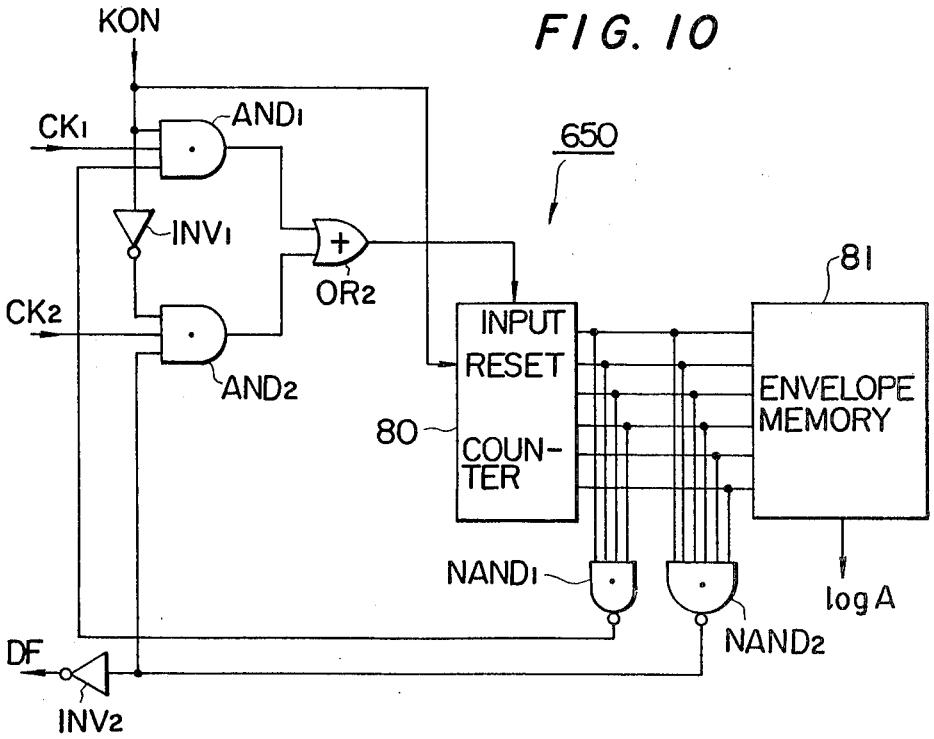

ELECTRONIC MUSICAL INSTRUMENT

BACKGROUND OF THE INVENTION (a) Field of the Invention

The present invention is concerned with an electronic musical instrument which produces a musical sound by computing the waveshape of a musical tone, and in particular, it pertains to an improvement in the computing system of musical tone waveshape.

(b) Brief Description of the Prior Art

A musical sound produced by a natural musical instrument, in general, represents a composite of a number of tone partials. Accordingly, in order to produce, by an electronic musical instrument, a musical sound resembling that of a natural musical instrument, there has to be formed a composite waveshape, i.e. a musical tone waveshape, of a number of different frequency components, i.e. tone partial components. As the above-said system for forming a musical tone waveshape, there are, roughly speaking, the following two kinds of systems. One of them is a system of synthesizing a musical tone waveshape out of the output signals of a number of oscillators. The other one is the system for obtaining a musical tone waveshape through computation. The former of the systems requires a number of oscillators, so that the electronic musical instrument which adopts the system tends to become complicated in structure and to become expensive. Thus, this system is not suitable for a production of a musical tone waveshape which is comprised of a number of tone partial components. The latter of the systems, on the other hand, has the possibility that an arbitrary musical tone waveshape can be obtained by a relatively simple means by a mere adequate selection of the method of computation.

A known typical technique of the system of computing a musical tone waveshape referred to above is disclosed in U.S. Pat. No. 3,809,786 entitled "COMPUTOR ORGAN". This known technique is such that a musical tone waveshape which is comprised of a number of harmonic components is computed in accordance with a discrete Fourier algorithm. During the respective sampling intervals of the musical tone waveshape which is to be produced, the sampling values of these respective harmonic components are computed at a high speed on time-division basis. The results of the computation are accumulated and thereby the value of sampling of the desired musical tone waveshape is obtained.

This known technique described just above, however, involves the following problem. That is, in case the number of the harmonic components which constitute a musical tone waveshape is large, the speed of calculation has to be increased to a very high degree, and accordingly there is required a device which is capable of conducting a remarkably high speed operation, in order to provide a computing means for use in the computation of the waveshape. In other words, the number of the tone partials of a musical sound which can be produced is subjected to limitation by the inherent operation speed of the computing device employed. Also, in view of the fact that a musical tone waveshape is computed in accordance with Fourier algorithm, it is difficult to produce a musical tone waveshape containing non-harmonic tone partial components.

SUMMARY OF THE INVENTION

It is, therefore, an object of the present invention to provide an electronic musical instrument designed so as to compute a musical tone waveshape by a novel computing system, and also designed to exhibit all of the advantages of the digital waveshape generation available by the known techniques.

Another object of the present invention is to provide an electronic musical instrument of the type described above, which is capable of producing a musical sound containing a number of tone partials.

Still another object of the present invention is to provide an electronic musical instrument of the type described above, which is capable of producing a musical sound which resembles realistically that of a natural musical instrument.

Yet another object of the present invention is to provide an electronic musical instrument of the type described above, which is simple in structure.

In order to attain these objectives mentioned above, according to the examples embodying the principle of the present invention, a musical tone waveshape is computed by multiplication and division of trigonometrical functions which use time as independent variables. The speed of this computation can be set arbitrarily independently of the number of the tone partials of such musical tone waveshape.

These and other objects as well as the features and the advantages of the present invention will become apparent by reading the following detailed description when taken in conjunction with the accompanying drawings.

BRIEF DESCRIPTION OF THE DRAWINGS

FIG. 9 is a circuit diagram showing a concrete example of the keyboard circuit in FIG. 6A.

FIG. 10 is a circuit diagram showing a concrete example of the envelope generator in FIG. 6B.

DETAILED DESCRIPTION OF THE PREFERRED EMBODIMENTS

Prior to describing the examples, explanation of the principles of the present invention will hereinafter be made.

In the present invention, the following Equation (1) or (2) is inferred to serve as the basic formulae of a musical tone waveshape which is comprised of a plurality of tone partial components:

$$F(x, y) = \sum_{k=1}^{n} \sin\{x + (k-1)y\} \quad \text{Equation (1)}$$

$$F(x, y) = \sum_{k=1}^{n} \cos\{x + (k-1)y\} \quad \text{Equation (2)}$$

wherein: x, y represent mathematical functions using time t as an independent variable, respectively.

Figure 1:
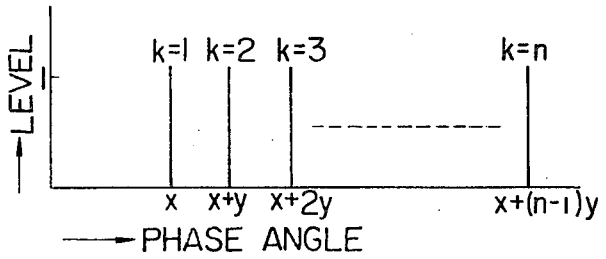
FIGS. 1 and 2 are diagrams showing basic spectrums of a musical sound which is obtained through the musical tone computing system according to the present invention, respectively.
Figure 2:
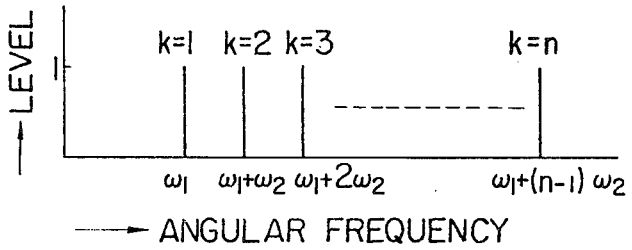

The musical tone waveshape which is shown by the above-mentioned formula (1) or (2) is comprised of tone partial components of n number which distribute at respective phase angles y as shown in FIG. 1. For example, in the above-mentioned equations, let us suppose $x = \omega_1 t$ and $y = \omega_2 t$, wherein $\omega_1$ and $\omega_2$ represent angular frequencies, respectively. Whereupon, these equations mean a musical tone waveshape of such spectrum distribution as shown in FIG. 2.

The right-hand part of the respective Equations (1) and (2) can be changed as follows:

Equation (3)

$$\sum_{k=1}^{n} \sin\{x + (k-1)y\} = \frac{\sin(x + \frac{n-1}{2} y) \cdot \sin \frac{n}{2} y}{\sin \frac{1}{2} y}$$

Equation (4)

$$\sum_{k=1}^{n} \cos\{x + (k-1)y\} = \frac{\cos(x + \frac{n-1}{2} y) \cdot \sin \frac{n}{2} y}{\sin \frac{1}{2} y}$$

In the present invention, a musical tone waveshape which is shown by Equation (1) or Equation (2) is obtained through computation of the right-hand part of the Equation (3) or Equation (4) mentioned above. As such, according to the present invention, it is possible to carry out the computation of the musical tone waveshape at an arbitrary speed of computation irrelevant of the number of the tone partial components which constitute the desired musical tone waveshape. In other words, it is possible to easily obtain a musical sound closely resembling a natural musical sound which contains a number of tone partials, without the fear that the permissible maximum number of the tone partial components contained in the musical tone waveshape is limited by the speed of operation of the computing means employed.

Figure 3:
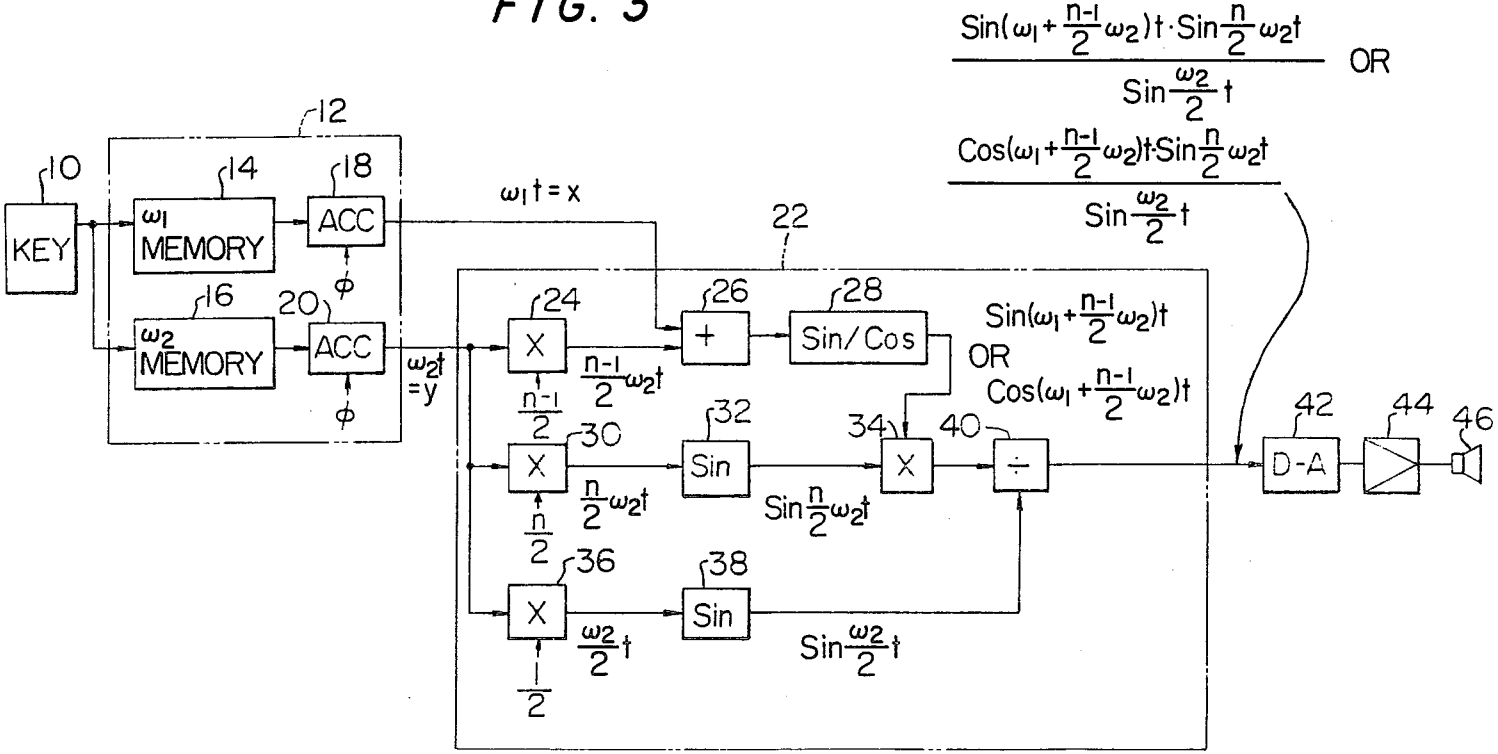
FIG. 3 is a block diagram showing a basic example of an electronic musical instrument embodying the present invention.

FIG. 3 is a block diagram showing an example embodying the principle of the elctronic musical instrument according to the present invention. This example is designed to obtain a musical tone waveshape through computation of the right-hand part of the following Equation (5) or Equation (6) which is obtained by the substitution of the above-mentioned Equations (3) or (4) with $x = \omega_1 t$ or $y = \omega_2 t$:

$$\sum_{k=1}^{n} \sin\{\omega_1 t + (k-1)\omega_2 t\} = \frac{\sin(\omega_1 t + \frac{n-1}{2} \omega_2 t) \cdot \sin \frac{n}{2} \omega_2 t}{\sin \frac{1}{2} \omega_2 t} \quad \text{Equation (5)}$$

$$\sum_{k=1}^{n} \cos\{\omega_1 t + (k-1)\omega_2 t\} = \quad \text{Equation (6)}$$

-continued $$\frac{\cos(\omega_1 t + \frac{n-1}{2} \omega_2 t) \cdot \sin \frac{n}{2} \omega_2 t}{\sin \frac{1}{2} \omega_2 t}$$

In FIG. 3 let us assume that a selected one of the keys of the keyboard arrangement not shown is depressed. Whereupon, there is outputted from a keyboard circuit 10 a key data signal representing the depressed key. An independent-variable generating circuit 12 is constructed with memories 14, 16 storing, in digital representation, angular frequency information $\omega_1$, $\omega_2$ corresponding to the respective keys of the keyboard, and with accumulators 18, 20. In the memories 14, 16, respective addresses both designated by a key data signal are accessed to read out the angular frequency information $\omega_1$ and $\omega_2$ corresponding to the depressed key, from the memories 14, 16. These read-out angular frequency information $\omega_1$ and $\omega_2$ are respectively led into the accumulators 18, 20 for each output of the timing pulse $\phi$ from the timing station not shown and these information signals are accumulated therein, and thus basic ingredient variables $x = \omega_1 t$ and $y = \omega_2 t$ are formed for the subsequent computation.

A computing circuit 22 is designed to carry out the computation of a musical tone waveshape, using the inputted variables $\omega_1 t$, $\omega_2 t$ in accordance with Equation (5) or Equation (6). The variable $\omega_2 t$ is multiplied by a multiplier $(n-1)/2$ in a multiplying circuit 24. As a result, $(n-1)/2\ \omega_2 t$ and the variable $\omega_1 t$ are added together by an adder 26. The result of this addition: $\omega_1 t + (n-1)/2\ \omega_2 t$ being used as an address information for a sinusoidal table memory 28, the value "$\sin(\omega_1 t + (n-1)/2\ \omega_2 t)$" [in case the computation is performed in accordance with Equation (5)] or the value "$\cos(\omega_1 t + (n-1)/2\ \omega_2 t)$" [in case the computation is performed in accordance with Equation (6)] is read out from the sinusoidal table memory 28, and the read-out signal is delivered as a multiplier to a multiplying circuit 34. In a multiplying circuit 30, the variable $\omega_2 t$ is multiplied by a multiplier n/2. The result $n/2\ \omega_2 t$ is used as the address information signal for a sine table memory 32, and the sine table memory 32 is accessed to read out the value $\sin n/2\ \omega_2 t$ therefrom. This read-out value $\sin n/2\ \omega_2 t$ is multiplied by either a multiplier $\sin(\omega_1 t + (n-1)/2\ \omega_2 t)$ or by a multiplier $\cos(\omega_1 t + (n-1)/2\ \omega_2 t)$ in the multiplying circuit 34. The result of this computation is inputted as a dividend to a divider 40. Also, the variable $\omega_2 t$ is multiplied by a multiplier $\frac{1}{2}$ in a multiplying circuit 36. Using the result $\frac{1}{2}\omega_2 t$ of this computation as an address information signal, a sine table memory 38 is accessed to read out the value $\sin\frac{1}{2}\omega_2 t$, to be delivered as a divisor to the divider 40. This divider 40 divides the dividend delivered from the multiplying circuit 34 by the divisor delivered from the sine table memory 38. The heretofore mentioned computations are carried out in a digital manner. Thus, digital representations of the sample values of the musical tone waveshape corresponding to the depressed key are derived in succession at the output of the divider 40.

The output of the computing circuit 22 is converted to an analog voltage by a digital-to-analog converter 42 and this analog voltage is inputted to an amplifier 44 of a sound producing system for being amplified therein to be outputted as a musical sound from a speaker 46.

It should be understood that the independent-variable generating circuit 12 and the computing circuit 22 may be formed into analog arrangements, respectively. In such an instance, the output of computation can be directly inputted to the sound producing system.

In the explanation stated above, description has been made on the instance wherein all of the levels of the respective tone partial components of the musical tone waveshape are uniform. An actual musical sound, however, has a frequency characteristic peculiar to a musical instrument, i.e. it has a tone color. As such, in order to obtain a musical sound closely resembling a natural musical sound, it is necessary to vary the relative levels of the respective tone partial components to thereby form a musical tone waveshape having a desired frequency characteristic.

As a means of imparting a desired frequency characteristic to a musical tone waveshape, there is a method of passing, through an appropriate filter means, the musical tone waveshape computed in accordance with either the above-mentioned Equation (3) or Equation (4). There is, however, a substantial difficulty in general in fabricating in a simple manner the filter means for use in attaining such objective as stated just above. As another such method, there can be conceived the technique introducing, into the computation formulae of a musical tone waveshape, the weighting factors for the respective tone partial components. This latter method can be said as being advantageous in the construction of an electronic musical instrument so long as the computation formulae employed for this purpose will not become markedly complicated.

Hereunder will be explained some examples of the method of the present invention for computing a musical tone waveshape imparted with a frequency characteristic.

For example, let us consider an instance wherein the weighting coefficient for the respective tone partial components is $\sin\{\alpha + (k-1)\beta\}$. The above-mentioned Equation (3) can be modified into the following equation:

Equation (7)

$$F(x,y) = \sum_{k=1}^{n} \sin\{\alpha + (k-1)\beta\}\sin\{x + (k-1)y\}$$
$$= \frac{1}{2}\left[\frac{\cos\{(x-\alpha) + \frac{n-1}{2}(y-\beta)\}\cdot\sin\{\frac{n}{2}(y-\beta)\}}{\sin\frac{y-\beta}{2}} + \frac{\cos\{(x+\alpha) + \frac{n-1}{2}(y+\beta)\}\cdot\sin\{\frac{n}{2}(y+\beta)\}}{\sin\frac{y+\beta}{2}}\right]$$

wherein: $\alpha$, $\beta$ represent parameters for determining the frequency characteristic, respectively.

Figure 4:
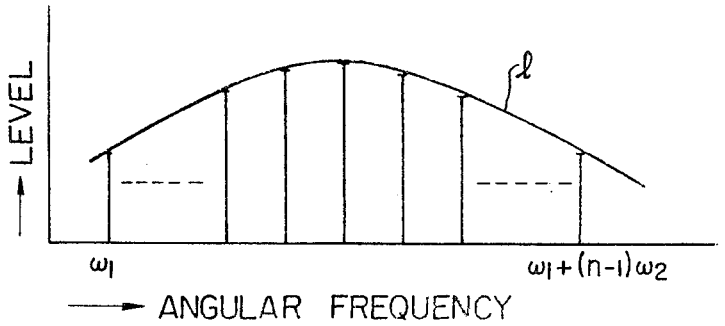
FIGS. 4 and 5 are diagrams showing other examples of spectrum of a musical sound which is obtained through the musical tone computing system according to the present invention, respectively.

By appropriately setting the values of the parameters $\alpha$ and $\beta$, there can be obtained a musical tone waveshape having a spectrum distribution as shown in FIG. 4, by the computation of Equation (7) mentioned above. More specifically, there can be directly obtained a musical tone waveshape having a frequency characteristic which is equivalent to that obtained after the passage through a band pass filter. It should be understood here that, in FIG. 4, x and y are expressed in such a way that $x = \omega_1 t$ and $y = \omega_2 t$ (wherein: $\omega_1$ and $\omega_2$ represent angular frequencies, respectively). In other words, in FIG. 4, the pitch of the convexed shape of the envelope curve 1 is determined depending on the value of the parameter $\beta$, and the phase of this envelope curve 1, in turn, depends on the parameter $\alpha$.

In the same way, the weighting coefficient for the respective tone partial components, $\sin^2\{\alpha + (k-1)\beta\}$ is introduced in the Equation (3), and as a result the following equation is obtained:

Equation (8)

$$F(x,y) = \sum_{k=1}^{n} \sin^2\{\alpha + (k-1)\beta\}\cdot\sin\{x + (k-1)y\}$$
$$= 2\cdot\frac{\sin(x + \frac{n-1}{2}y)\cdot\sin\frac{n}{2}y}{\sin\frac{y}{2}} - \frac{\sin\{(x+2\alpha) + \frac{n-1}{2}(y+2\beta)\}\cdot\sin\frac{n}{2}(y+2\beta)}{\sin\frac{1}{2}(y+2\beta)} - \frac{\sin\{(x-2\alpha) + \frac{n-1}{2}(y-2\beta)\}\cdot\sin\frac{n}{2}(y-2\beta)}{\sin\frac{1}{2}(y-2\beta)}$$

Figure 5:
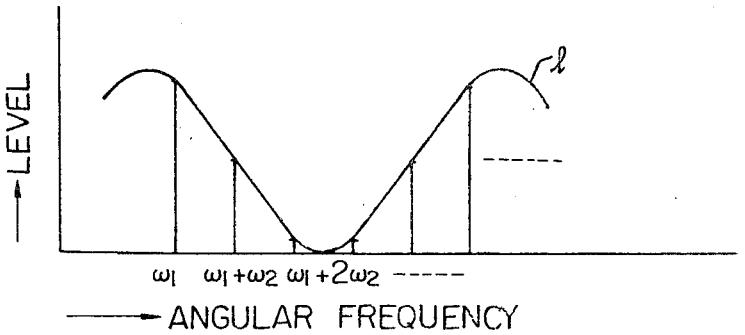

The spectrum distribution of the musical tone waveshape which is obtained through computation of the above-mentioned Equation (8) when the parameters $\alpha$ and $\beta$ take certain values is shown in FIG. 5. As will be understood from FIG. 5, it is possible to directly obtain, from the computation of the Equation (8), a musical tone waveshape having a frequency characteristic similar to that obtained after the passage through a filter means having a waved frequency characteristic. It should be understood that, in FIG. 5, x and y are expressed as $x = \omega_1 t$ and $y = \omega_2 t$, respectively, and that the pitch and the phase of the waved envelope curve 1 depend on the parameters $\beta$ and $\alpha$, respectively.

As explained above, it should be noted that, by introducing a weighting coefficient into the computing formulae, it is possible to make direct computation of a musical tone waveshape having an arbitrary frequency characteristic, i.e. a tone color. It will be understood easily also that, by varying with time the weighting coefficient, it is possible to obtain a musical sound whose tone color varies with time. For example, in Equation (7) and Equation (8), as a means of imparting the tone color a time-dependent variation, there can be conceived to vary the parameters $\alpha$ and $\beta$ with time.

Figure 6A:
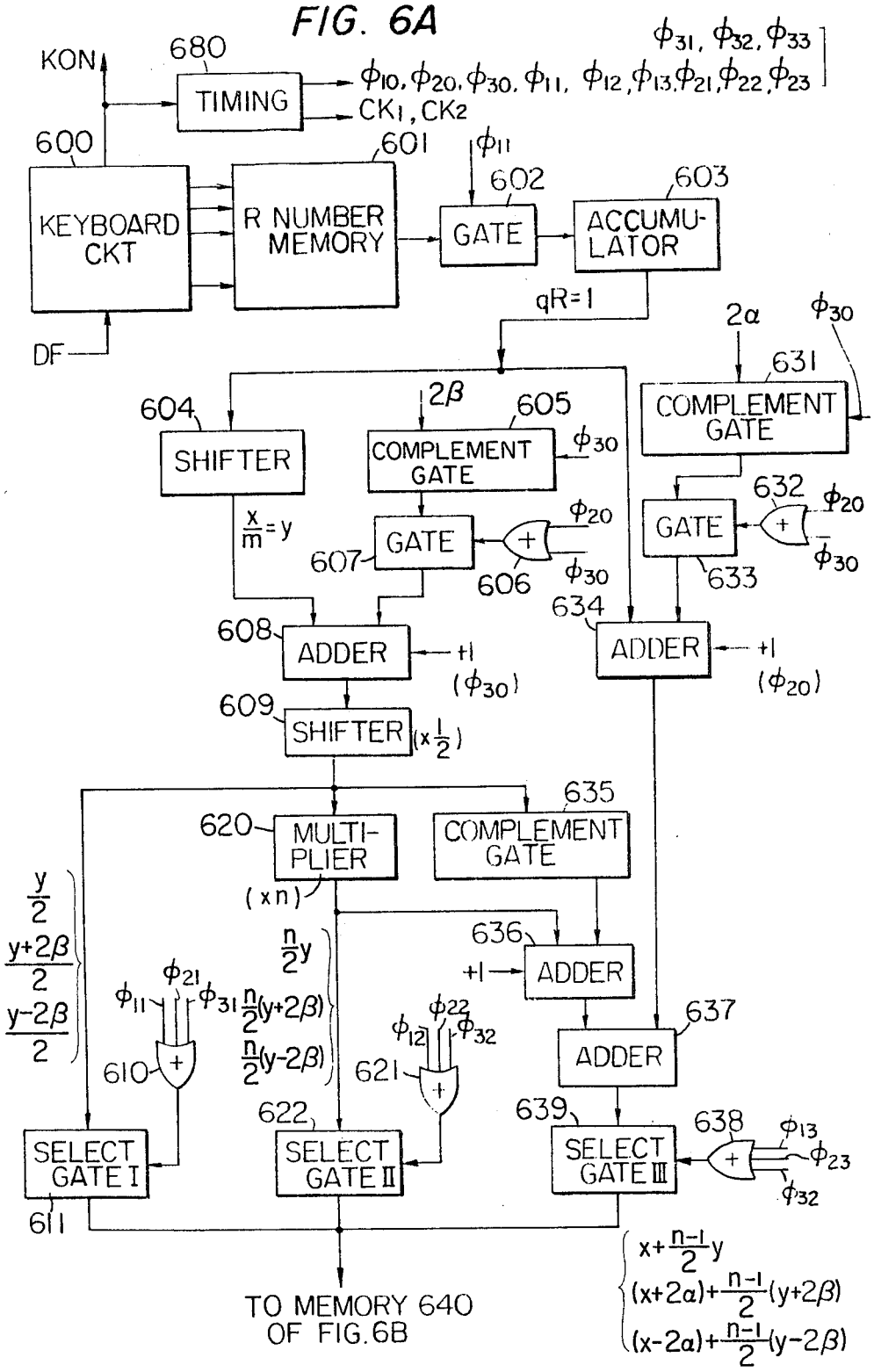
FIGS. 6A and 6B are block diagrams showing a practical example of an electronic musical instrument according to the present invention.
Figure 6B:
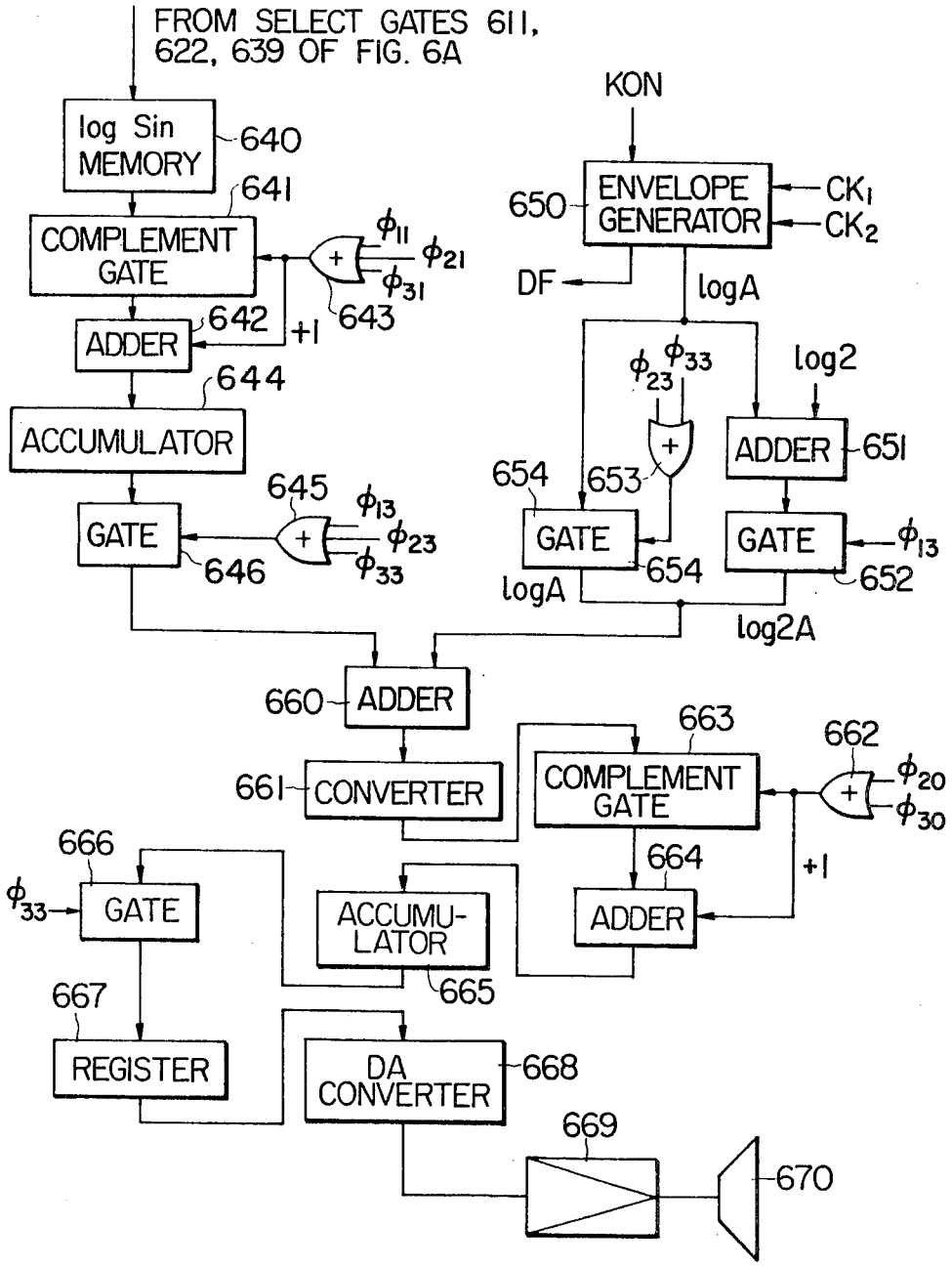

FIGS. 6A and 6B are block diagrams showing a practical example of an electronic musical instrument according to the present invention which is arranged so as to compute a musical tone waveshape in accordance with the above-mentioned Equation (8).

The operation timing of this electronic musical instrument is controlled by the timing pulses $\phi_{10}$, $\phi_{11}$, $\phi_{12}$, $\phi_{13}$, $\phi_{20}$, $\phi_{21}$, $\phi_{22}$, $\phi_{23}$, $\phi_{30}$, $\phi_{31}$, $\phi_{32}$, $\phi_{33}$ which are delivered from a timing circuit 680. Explanation will be made, by referring to FIGS. 7 and 8, with respect to the mutual relations of timing of the group of these timing pulses and with respect to an example of the timing circuit 680.

Figures 7A, 7B, 7C, 7D, 7E:
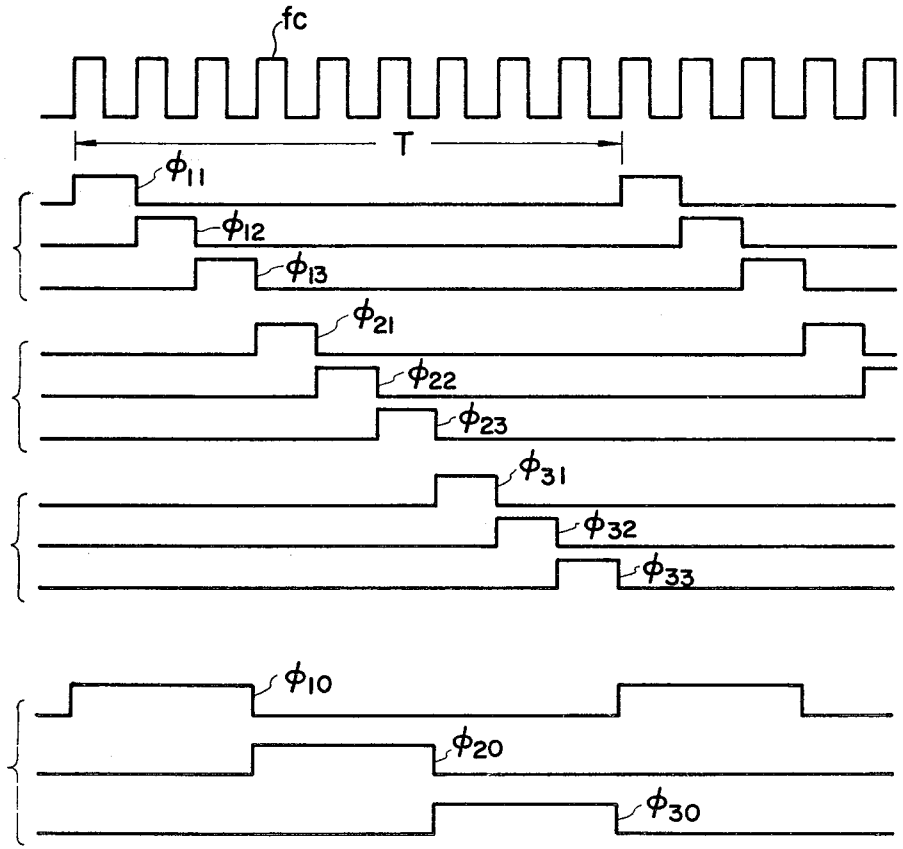
FIG. 7 is a timing chart showing the timing pulses for controlling the progress of the operation of the electronic musical instrument shown in FIGS. 6A and 6B.
Figure 8:
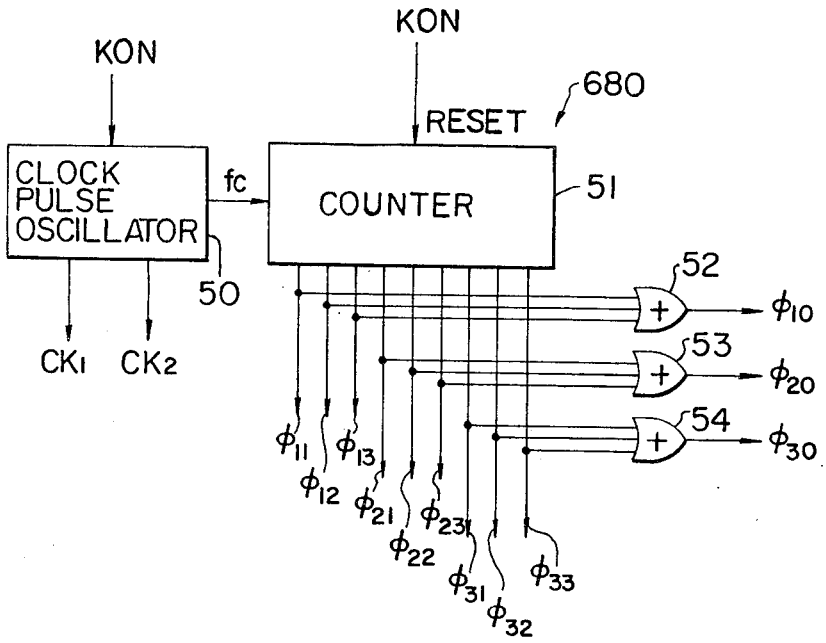
FIG. 8 is a circuit diagram showing a concrete example of the timing circuit in FIG. 6A.

In FIG. 8, the output pulses $f_c$ of a clock pulse oscillator 50 (see FIG. 7A) are counted successively by a counter 51. With these outputs of the counter 51 are formed a first group of pulses $\phi_{11}$, $\phi_{12}$, $\phi_{13}$ (FIG. 7B), a second group of pulses $\phi_{21}$, $\phi_{22}$, $\phi_{23}$ (FIG. 7C), and a third group of pulses $\phi_{31}$, $\phi_{32}$, $\phi_{33}$ (FIG. 7D). With the pulses of the respective groups from the first to the third are formed pulses $\phi_{10}$, $\phi_{20}$, $\phi_{30}$ (FIG. 7E) via OR circuits 52, 53, 54 respectively.

During the period T from the time of rise of the pulse $\phi_{11}$ till the time of rise of the next pulse $\phi_{11}$, the computation of the right-hand part of Equation (8) is conducted once.

It should be noted that the pulse $\phi_{10}$ represents the timing of computing the first member $$\left[\frac{\sin\left(x+\frac{n-1}{2}y\right)\sin\frac{n}{2}y}{\sin\frac{y}{2}}\cdot 2\right]$$

of Equation (8). Pulses $\phi_{11}$, $\phi_{12}$, $\phi_{13}$ represent the respective timing of successively conducting the computation of the respective components sin y/2, sin n/2 y, sin(x + (n−1)/2 y) of said first member of Equation (8). Hereinafter, the above-mentioned components will be referred to as the first component, the second component and the third component of said first member of Equation (8), respectively. Also, pulse $\phi_{20}$ represents the timing of computing the second member $$\left[\frac{\sin\left\{(x+2\alpha)+\frac{n-1}{2}(y+2\beta)\right\}\cdot\sin\frac{n}{2}(y+2\beta)}{\sin\frac{1}{2}(y+2\beta)}\right]$$

of Equation (8). Pulses $\phi_{21}$, $\phi_{22}$, $\phi_{23}$ represent the respective timing of successively conducting the computation of the respective components sin ½ (y + 2β), sin n/2 (y + 2β), and sin{(x + 2α) + (n−1)/2 (y + 2β)} of the second member of Equation (8). Hereinafter, the above-mentioned components will be referred to as the first component, the second component and the third component of said second member of Equation (8), respectively. Similarly, pulse $\phi_{30}$ represents the timing of computing the third member $$\left[\frac{\sin\left\{(x-2\alpha)+\frac{n-1}{2}(y-2\beta)\right\}\cdot\sin\frac{n}{2}(y-2\beta)}{\sin\frac{1}{2}(y-2\beta)}\right]$$

of Equation (8).

Pulses $\phi_{31}$, $\phi_{32}$, $\phi_{33}$ represent the respective timing of successively conducting the computation of the respective components sin ½ (y − 2β), sin n/2 (y − 2β), and sin{(x−2α)+(n−1)/2 (y − 2β)} of the third member of Equation (8). Hereinafter, the above-mentioned components will be referred to as the first component, the second component and the third component of said third member of Equation (8), respectively.

The apparatus shown in FIGS. 6A and 6B is driven by such pulses as mentioned above to compute Equation (8), and thus a musical tone waveshape is formed. These operations will be explained hereinafter in the order of the respective actions of computing the respective members of Equation (8). By doing so, the arrangement of the examples of the present invention will be elucidated.

In FIGS. 6A and 6B, let us assume that a key of the keyboard arrangement not shown is depressed. Whereupon, a key-on signal KON is generated by the keyboard circuit 600. Also, there is read out, from the R number memory 601, a frequency information signal R having a value proportional with the frequency of the musical sound corresponding to the depressed key. This frequency information signal R which has been read out from the R number memory 601 is transmitted to an accumulator 603 via a gate 602 which is opened by said pulse $\phi_{11}$ of a constant cycle, to be accumulated there at the timing of this pulse $\phi_{11}$. More specifically, there are obtained within this accumulator 603 a value 1R for the first-generated pulse $\phi_{11}$ after key-on, and a value 2R for the second-generated pulse $\phi_{11}$ and in the similar way thereafter a value qR for the q-th pulse $\phi_{11}$. In this way, the information corresponding to the variable x of Equation (8) is formed by the respective timing of the pulses $\phi_{11}$. In this case, the accumulator 603 has a modulus of a certain value. This accumulator 603 behaves in such a way that the value of the variable x will increase from zero to the modulus at intervals of R, and that when the value of the variable x has surpassed the value of the modulus, the difference between such value and the value of the modulus is retained within the accumulator 603. In this case, it should be noted that the value of the frequency information signal R which is applied to the accumulator 603 is proportional, as stated previously, to the frequency of the musical sound which is to be produced, and that therefore the variation of the variable x, i.e. the frequency of the repetition of said rising of the value of this variable, is proportional to the frequency of the musical sound to be produced. Arrangement is provided to be operative so that the clock pulse oscillator 50 is triggered by the key-on signal KON to re-set the counter 51. Accordingly, the respective groups of pulses are synchronized with the build-up of the key-on signal.

An example of the above-mentioned keyboard circuit 600 is shown in FIG. 9. Symbols $K_1$ through $K_n$ represent key switches which are opened and closed in accordance with the operation of the respective keys of the keyboard arrangement. When a selected key is operated, the corresponding key switch among the key switches $K_1 \sim K_n$ is closed. Via this switch, the potential of the power source E is applied to one of the input terminals of the OR gate $OR_1$. And a key-on signal KON is outputted therefrom. Also, at the same time therewith, the potential of the power source E is applied to the set terminal of that particular flip-flop corresponding to the depressed key among the flip-flops $FF_1 \sim FF_n$ which are arranged to correspond to the respective keys. Whereby, said corresponding particular flip-flop is rendered to its set state. The output of the flip-flop in the group $FF_1 \sim FF_n$ serves as the address signal for designating the address for accessing the R number memory 601. It should be understood that the re-setting of the flip-flop $FF_1 \sim FF_n$ is performed by the decay finishing signal DF which is generated upon finishing of the decay of the musical sound, as will be discussed later.

The respective components of the respective members of Equation (8) are formed based on the values $x = qR$ (wherein q = 1, 2, . . .) of the timing variable discussed above. Ultimately, these components are accumulated and thus a musical sound is formed.

The behavior of the apparatus of this example will hereunder be described, along with making explanation of the respective constituting parts of the apparatus of FIGS. 6A and 6B.

I. Formation of y/2, (y+2β)/2, (y−2β)/2 in the first component of the respective members of Equation (8)

A shifter 604 is intended to carry out division by a shift operation. This shifter 604 outputs a timing variable $x/m = y$ based on the aforesaid timing variable x, wherein m is an arbitrarily selected value.

A complement gate 605 is designed to be operative so that, during the periods of the pulses $\phi_{10}$ and $\phi_{20}$, it outputs a set value 2β which is given by a setter not shown, and that during pulse $\phi_{30}$ it outputs a complement value $-2\beta$ which is the binary complement of the set value $2\beta$.

A gate 607 is designed so as to be opened either by the pulse $\phi_{20}$ or by the pulse $\phi_{30}$ which is supplied via an OR circuit 606.

It will be understood from the foregoing explanation that, for the period of the pulse $\phi_{20}$, the set value $2\beta$ is inputted to an adder 608, whereas for the period of the pulse $\phi_{30}$, the complement value $-2\beta$ is inputted to this adder 608. Accordingly, this adder 608, for the period of the pulse $\phi_{10}$, delivers the timing variable y as it is, whereas for the period of the pulse $\phi_{20}$, it delivers the value $y + 2\beta$ which is the sum of the timing variable y and the set value $2\beta$. Also, for the period of the pulse $\phi_{30}$, it delivers the value $y - 2\beta$ which is the sum of the timing variable y and the complement value $-2\beta$. It should be understood that, for the period of the pulse $\phi_{30}$, the adder 608 adds up a constant "1" for carrying out the subtraction (addition of complement) in this adder 608.

The outputs y, $y + 2\beta$, $y - 2\beta$ of this adder 608 are transmitted to a shifter 609 for making its input signal to $\frac{1}{2}$. More specifically, for the period of the pulse $\phi_{10}$, the value y/2 is outputted from the shifter 609. For the period of the pulse $\phi_{20}$, the value $(y + 2\beta)/2$ is outputted therefrom. Also, for the period of the pulse $\phi_{30}$, there is outputted the value $(y - 2\beta)/2$ from the shifter 609. These values are inputted to the gate 611 of the first select gate 611.

II. Formation of n/2 y, $n/2\ (y + 2\beta)$, $n/2\ (y - 2\beta)$ in the second component of the respective members of Equation (8)

The above-mentioned outputs y/2, $(y + 2\beta)/2$, and $(y - 2\beta)/2$ of the shifter 609 are transmitted to a multiplying circuit 620 for the periods of the timing pulses $\phi_{10}$, $\phi_{20}$, $\phi_{30}$, respectively, to be multiplied by n in this multiplying circuit. As a result, there are derived the outputs n/2 y, $n/2\ (y + 2\beta)$, $n/2\ (y - 2\beta)$ from the multiplying circuit 620. These outputs n/2 y, $n/2\ (y + 2\beta)$, $n/2\ (y - 2\beta)$ serve as the inputs of the second select gate 622.

III. Formation of $x + (n-1)/2\ y$, $(x + 2\alpha) + (n-1)/2\ (y + 2\beta)$, $(x - 2\alpha) + (n-1)/2(y - 2\beta)$ in the third component of the respective members of Equation (8)

For the periods other than the period for the pulse $\phi_{30}$, i.e. for the periods of the pulses $\phi_{10}$ and $\phi_{20}$, a complement gate 631 outputs a set value $2\alpha$ which is given by a setter not shown. Also, for the period of the pulse $\phi_{30}$, this complement gate 631 outputs $-2\alpha$ which is the binary complement value of the set value $2\alpha$. A gate 633 is opened either by the pulse $\phi_{20}$ or by the pulse $\phi_{30}$ which is supplied via an OR gate 632. As will be understood therefrom, for the period of the pulse $\phi_{20}$, the set value $2\alpha$ serves as one of the two-route input signals of the adder 634. For the period of the pulse $\phi_{30}$, the complement value $-2\alpha$ serves as such input signal of this adder. Accordingly, during the period of the pulse $\phi_{10}$, this adder 634 delivers a timing variable x, whereas for the period of pulse $\phi_{20}$, it delivers $x + 2\alpha$ which is the sum of the timing variable x and the set value $2\alpha$. Also, during the period of the pulse $\phi_{30}$, it delivers $x - 2\alpha$ which is the sum of the timing variable x and the complement value $-2\alpha$. For the sake of carrying out a subtraction (addition of the complement), this adder adds up a constant "1", in the same way as that in the aforesaid adder 608.

An adder 636 adds up n/2 y, $n/2\ (y + 2\beta)$, $n/2\ (y - 2\beta)$ which are the outputs of a multiplying circuit 620 for the respective pulse periods $\phi_{10}$, $\phi_{20}$, $\phi_{30}$ and $-y/2$, $-(y + 2\beta)/2$, $-(y - 2\beta)/2$ which are the binary complements of the outputs of a shifter 609 which are delivered from a complement gate 635, and this adder 636 outputs the respective results of addition $(n - 1)/2$ y, $(n - 1)/2\ (y + 2\beta)$, $(n - 1)/2\ (y - 2\beta)$ for the respective pulse periods $\phi_{10}$, $\phi_{20}$, $\phi_{30}$. It should be noted here that to this adder 636 is added a constant "1" through the entire periods of the pulses $\phi_{10}$, $\phi_{20}$, $\phi_{30}$ for the reasons similar to those stated in connection with the adders 608 and 634.

The outputs x, $x + 2\alpha$, $x - 2\alpha$ of the adder 634 and the outputs $(n - 1)/2$ y, $(n - 1)/2\ (y + 2\beta)$, $(n - 1)/2\ (y - 2\beta)$ of the adder 636, which have been explained above are further added up together in an adder 637 for the respective periods of the timing pulses $\phi_{10}$, $\phi_{20}$ and $\phi_{30}$ so that the following values, i.e. $x + (n - 1)/2$ y, $(x + 2\alpha) + (n - 1)/2\ (y + 2\beta)$, $(x - 2\alpha) + (n - 1)/2\ (y - 2\beta)$ are formed. These values $x + (n - 1)/2$ y, $(x + 2\alpha) + (n - 1)/2\ (y + 2\beta)$, $(x - 2\alpha) + (n - 1)/2\ (y - 2\beta)$ serve as the inputs of a third select gate 639.

IV. Formation of the respective members of Equation (8) — Part 1

Next, the respective members on the right-hand part of Equation (8) are computed by the outputs of the select gates 611, 622, 639 which have been explained above. These computations are carried out by the use of logarithmic indications. More specifically, the first member $$\left[\frac{\sin(x + \frac{n-1}{2}y)\sin\frac{n}{2}y}{\sin\frac{y}{2}}\right],$$

for example, is subjected to logarithmic computation in accordance with $\log \sin(x + (n - 1)/2\ y) + \log \sin n/2\ y - \log \sin y/2$.

During the period of the pulse $\phi_{10}$, pulses $\phi_{11}$, $\phi_{12}$, $\phi_{13}$ successively are generated and they are applied, via OR gates 610, 621, 638, to the select gates 611, 622, 639 to thereby open these select gates 611, 622, 639 successively. Also, as has been explained in paragraphs I ~ III above, those signals which are inputted, for the period of the pulse $\phi_{10}$, to the select gates 611, 622, 639 are y/2, n/2 y, $x + (n - 1)/2$ y. Accordingly, from these select gates 611, 622, 639 are outputted the signals y/2, n/2 y, $x + (n - 1)/2$ y in accordance with the order of generation of the timing pulses $\phi_{11}$, $\phi_{12}$, $\phi_{13}$ respectively, as the address signals for a memory 640.

This memory 640 is designed to store a sine value in a logarithmic representation. Therefore, this memory 640 outputs log sin y/2, log sin n/2 y, log sin $(x + (n - 1)/2\ y)$ in accordance with the order of generation of the pulses $\phi_{11}$, $\phi_{12}$ and $\phi_{13}$.

In the same way, during the periods of the pulses $\phi_{21}$, $\phi_{22}$, $\phi_{23}$, there are outputted the signals $(y + 2\beta)/2$, $n/2\ (y + 2\beta)$, $(x + 2\alpha) + (n - 1)/2\ (y + 2\beta)$ successively from the select gates 611, 622, 639, respectively. Accordingly, from the memory 640 is read out log sin $(y + 2\beta)/2$, log sin $n/2\ (y + 2\beta)$, log sin $\{(x + 2\alpha) + (n - 1)/2\ (y + 2\beta)\}$.

Also, during the periods of the pulses $\phi_{31}$, $\phi_{32}$, $\phi_{33}$, there are successively outputted from the select gates 611, 622, 639 the signals $(y - 2\beta)/2$, $n/2\ (y - 2\beta)$, $(x - 2\alpha) + (n - 1)/2\ (y - 2\beta)$, respectively. Accordingly, there are successively read out, from the memory 640, the signals log sin (y − 2β)/2, log sin n/2 (y − 2β), log sin {(x − 2α) + (n − 1)/2 (y − 2β)}, respectively.

A complement gate 641, during the period in which either one of the pulses $\phi_{11}$, $\phi_{21}$, $\phi_{31}$ is supplied via an OR gate 643, outputs a binary complement of its input. During those periods other than said period, this complement gate 641 outputs its input as it is. An adder 642 is provided based on the consideration that the outputs of said complement gate are accumulated by an accumulator 644. More specifically, during the period in which a complement value is outputted from the complement gate 641, i.e. during the periods of the pulses $\phi_{11}$, $\phi_{21}$, $\phi_{31}$, there is added in an adder 642 a constant "+1" which is necessary for carrying out an addition of complement in the accumulator 644 to the above-said complement value.

Accordingly, in accordance with the order of the pulses $\phi_{11}$, $\phi_{12}$, $\phi_{13}$ which are generated for the period of the pulse $\phi_{10}$, there are accumulated the signals − log sin y/2, log sin n/2y, log sin (x + (n − 1)/2) y in the accumulator 644. More specifically, during the period of the pulse $\phi_{10}$, the accumulator 644 computes $$-\log\sin\frac{y}{2} + \log\sin\frac{n}{2}y + \log\sin(x+\frac{n-1}{2}y) = \log\frac{\sin(x+\frac{n-1}{2}y)\sin\frac{n}{2}y}{\sin\frac{y}{2}}.$$

The result of this computation is delivered, via a gate 646, to an adder 660 upon decay of the final pulse $\phi_{13}$ generated for the period of the pulse $\phi_{10}$.

In the same way, in accordance with the order of the pulses $\phi_{21}$, $\phi_{22}$, $\phi_{23}$ which are generated during the period of the pulse $\phi_{20}$, there are successively accumulated the signals − log sin (y + 2β)/2, log sin n/2 (y + 2β), log sin{(x + 2α) + (n − 1)/2 (y + 2β)} in the accumulator 644. More specifically, during the period of the pulse $\phi_{20}$, this accumulator 644 carries out the computation $$-\log\sin\frac{y+2\beta}{2} + \log\sin\frac{n}{2}(y+2\beta) + \log\sin\{(x+2\alpha)+\frac{n-1}{2}(y+2\beta)\} = \log\frac{\sin\{(x+2\alpha)+\frac{n-1}{2}(y+2\beta)\}\sin\frac{n}{2}(y+2\beta)}{\sin\frac{y+2\beta}{2}}$$

and, at the decay of the pulse $\phi_{23}$, the accumulator 644 delivers the result of this computation to an adder 660 via a gate 646.

In the same way also, in accordance with the order of the pulses $\phi_{31}$, $\phi_{32}$, $\phi_{33}$ which are generated during the period of the pulse $\phi_{30}$, there are successively accumulated, in the accumulator 644, the signals −log sin (y − 2β)/2, log sin n/2 (y − 2β), log sin }(x − 2α) + (n − 1)/2 (y − 2β)}. More specifically, during the period of the pulse $\phi_{30}$, the accumulator 644 carries out the computation $$-\log\sin\frac{y-2\beta}{2} + \log\sin\frac{n}{2}(y-2\beta) +$$

-continued $$\log\sin\{(x-2\alpha)+\frac{n-1}{2}(y-2\beta)\} = \log\frac{\sin\{(x-2\alpha)+\frac{n-1}{2}(y-2\beta)\}\sin\frac{n}{2})y-2\beta)}{\sin\frac{y-2\beta}{2}}$$

and, at the decay of the pulse $\phi_{30}$, the accumulator 644 delivers, via the gate 646, the result of this computation to the adder 660.

V. Formation of the respective members of Equation (8) — Part 2 — Imparting of envelope As stated above, the results of computation of the respective members on the right-hand part of Equation (8) are obtained in logarithmic representations at the output of the gate 646. According to the instant example, arrangement is provided so that the results of computation of the respective members of Equation (8) are multiplied by an envelope coefficient, to thereby obtain a musical sound which is imparted with such envelope characteristic.

An envelope generator 650 is arranged so as to be driven by a key-on signal KON and is provided to form an envelope coefficient for specifying the attack, sustain and decay of the waveshape of the musical sound. An example of such envelope generator 650 is shown in FIG. 10. In FIG. 10, symbols $AND_1$ and $AND_2$ represent AND gates. $NAND_1$ and $NAND_2$ represent NAND gates. $OR_2$ represents an OR gate. $INV_1$ represents an inverter. Reference numeral 80 represents a counter, and 81 represents an envelope memory which stores the logarithmic value of an envelope waveshape A.

The operation of this envelope generator 650 is as follows. Firstly, when a key-on signal KON is generated by the operation of a key, the counter 80 is re-set, and its output becomes "0". Accordingly, the output of the first NAND gate $NAND_1$ becomes "1". Accordingly, a clock pulse $CK_1$ which is generated from the timing circuit 680 for the formation of "attack" envelope is inputted to the counter 80 via the AND gate $AND_1$ and the OR gate $OR_2$, and is counted up therein. With this output of the counter 80 serving as the address information signal, the envelope memory 81 is accessed. Thus, an attack envelope information $\log A_a$ is read out. When the count of this counter 80 reaches a predetermined count value, for example 16, and when accordingly the entire input of the NAND gate $NAND_1$ becomes "0", the output of the first NAND gate $NAND_1$ is reversed to become "0". As a result, the AND gate $AND_1$ is closed, and accordingly the clock $CK_1$ for attack formation will cease to be inputted to the counter 80. Thus, the count value of the counter 80 is held stationary at "16", so that a sustain envelope information $\log A_s$ continues throughout the period of key-depression and is read out from the envelope memory 81.

Upon release of the key, the key-on signal KON disappears. As a result, the output of the inverter $INV_1$ becomes "1". At such a time, the output of the NAND gate $NAND_2$ is "1". Accordingly, a decay-forming clock $CK_2$ which is delivered from the timing circuit 680 is inputted to the counter 80 via the AND gate $AND_2$ and the OR gate $OR_2$, so that the counter 80 again starts its counting-up operation. This output of the counter 80 being used as the address information, the envelope memory 81 is accessed, and thus a decay envelope information $\log A_d$ is read out.

When, in this way, the count of the counter 80 has reached a predetermined count value, for example 64, and when the entire input of the second NAND gate $NAND_2$ becomes "1", the output of this NAND gate $NAND_2$ is reversed to become "0". Accordingly, the AND gate $AND_2$ is closed, and as a result the counting-up operation of the counter 80 ceases. Also, the decay-finishing signal DF — which is the output of the inverter $INV_2$ representing the inverted output of the NAND gate $NAND_2$ — becomes "1". Whereby, the afore-said flip-flop circuits $FF_1 \sim FF_n$ of FIG. 9 are re-set.

The envelope information logA (which is the general term covering an attack envelope information $\log A_a$, a sustain envelope information $\log A_s$, and a decay envelope information $\log A_d$) which has been read out from the envelope generator 650 is added, in an adder 651, to the set value log2. The result thereof is inputted to an adder 660 via a gate 652 which is opened upon generation of the final pulse $\phi_{13}$ for the period of the first pulse $\phi_{10}$. On the other hand, when a pulse $\phi_{23}$ and a pulse $\phi_{33}$ are supplied via the OR gate 635 to the second pulse $\phi_{20}$ and to the third pulse $\phi_{30}$, respectively, the output logA of the envelope generator 650 is directly inputted to the adder 660 via the gate 654.

In this way, the adder 660 operates to add the envelope information to the results of computation of the respective members of Equation (8) which are outputted from the gate 646 for the pulses $\phi_{13}$, $\phi_{23}$, $\phi_{33}$ to thereby form an envelope. The output of this adder 660 is converted, by a converter 661, to an antilogarithmic representation.

Accordingly, from the converter 661 are successively outputted — in correspondence to the respective pulses of $\phi_{13}$, $\phi_{23}$, $\phi_{33}$ — those results of computation of the respective members of Equation (8) which have been imparted with an envelope, i.e. the below-mentioned values representing the respective members of Equation (8) which have been multiplied by A, respectively:

$$2A\frac{\sin(x+\frac{n-1}{2}y)\sin\frac{n}{2}y}{\sin\frac{y}{2}},$$

$$A\frac{\sin\{(x+2\alpha)+\frac{n-1}{2}(y+2\beta)\}\sin\frac{n}{2}(y+2\beta)}{\sin\frac{1}{2}(y+2\beta)},$$

$$A\frac{\sin\{(x-2\alpha)+\frac{n-1}{2}(y-2\beta)\}\sin\frac{n}{2}(y-2\beta)}{\sin\frac{1}{2}(y-2\beta)}$$

VI. Addition of the respective members of Equation (8) — Formation of a musical sound A circuit which is comprised of a complement gate 663, an OR gate 662, an adder 664 and an accumulator 665 carries out, by the use of the output of a converter 661, the computation of the following equation:

$$\sum_{k=1}^{n} A\cdot\sin^2\{\alpha+(k-1)\beta\}\cdot\sin\{x+(k-1)y\} \qquad \text{Equation (9)}$$

$$= A\cdot[2\cdot\frac{\sin(x+\frac{n-1}{2}y)\cdot\sin\frac{n}{2}y}{\sin\frac{y}{2}}$$

-continued $$-\frac{\sin\{(x+2\alpha)+\frac{n-1}{2}(y+2\beta)\}\cdot\sin\frac{n}{2}(y+2\beta)}{\sin\frac{1}{2}(y+2\beta)}$$

$$-\frac{\sin\{(x+2\alpha)+\frac{n-1}{2}(y+2\beta)\}\cdot\sin\frac{n}{2}(y+2\beta)}{\sin\frac{1}{2}(y+2\beta)}]$$

This Equation (9) represents that the left-hand and the right-hand parts of Equation (8) are multiplied by A, respectively.

The value itself of the first member of Equation (9) which is outputted from the converter 661 during the period of the pulse $\phi_{10}$ is loaded via the complement gate 663 and the adder 664 onto the accumulator 665. Thereafter, the value of the second member of Equation (9) which is outputted from the converter 661 during the period of the pulse $\phi_{20}$ is converted to its binary complement through the complement gate 663, and this complement value is then added with "+1" in the adder 664 and then it is loaded onto the accumulator 665 in which the loaded value is added with the first member contained in the accumulator 665. The value of the third member which is outputted from the converter 661 is converted to its binary complement via the complement gate 663, and this complement value is added with "+1" in the adder 664 and then the resulting value is loaded onto the accumulator 665 in which the value is added with the contents of this accumulator 665. Thus, in the accumulator 665, there is obtained the result of computation of the right-hand part of Equation (9). This result of computation is temporarily stored in a register 667 via a gate 666 which is opened by the pulse $\phi_{33}$. At the time when this storing is completed, the accumulator 665 is cleared. The contents of the register 667 are converted to an analog signal by a digital-to-analog converter 668, and after this analog signal is subjected to a desired treatment by a sound producing system 669 containing amplifier, etc., it is sounded as a musical sound from a speaker 670.

According to this instant example, there is carried out the multiplication of an envelope coefficient for each member of Equation (9) prior to carrying out the addition-subtraction operations of the respective members on the right-hand part of Equation (9). It should be understood, however, that the multiplication of the envelope coefficient may be done in the stage subsequent to the accumulator 665 or after the conversion into the analog signal.

I claim:

1. In equipment for developing a waveshape and converting the waveshape to a signal in a desired frequency range, the improvement of a system for generating a composite waveshape having n possible components of different frequency in the amplitude of any sample point of the waveshape, comprising:

a first means for generating a first timing variable x;

a second means for generating a second timing variable y; and a third means for carrying out, by the use of said first and second timing variables x and y, computation of a waveshape F(x, y) in accordance with the equation:

$$F(x, y) = \frac{\sin(x + \frac{n-1}{2} y) \cdot \sin \frac{n}{2} y}{\sin \frac{1}{2} y}$$

wherein: n is a nonincrementing single integer greater than one, said third means including means for calculating the waveshape amplitude for each desired successive sample point of said waveshape by computing the right side of said equation only once per sample point regardless of the number or kind of said different frequency components contained in the waveshape amplitude at any sample point.

2. A waveshape generating system according to claim 1, in which:

said first means comprises:

means for generating a first constant $\omega_1$, and means for accumulating, at certain constant intervals, said first constant $\omega_1$ to form said first timing variable x, and in which:

said second means comprises:

means for generating a second constant $\omega_2$, and means for accumulating, at certain constant intervals, said second constant $\omega_2$ to form said second timing variable y.

3. A waveshape generating system according to claim 1, wherein:

said third means comprises:

means for computing a first phase angle $\theta_1$ in accordance with the equation:

$$\theta_1 = x + (n - 1)/2\, y;$$

means for computing a second phase angle $\theta_2$ in accordance with the equation:

$$\theta_2 = n/2\, y;$$

means for computing a third phase angle $\theta_3$ in accordance with the equation:

$$\theta_3 = \tfrac{1}{2} y;$$

means for obtaining sinusoidal values $\sin\theta_1$, $\sin\theta_2$ and $\sin\theta_3$ for said first, second and third phase angles $\theta_1$, $\theta_2$ and $\theta_3$, respectively;

means for multiplying the sinusoidal value $\sin\theta_1$ by the sinusoidal value $\theta_2$; and means for dividing the result of the multiplication by the sinusoidal value $\sin\theta_3$ to obtain said waveshape F(x, y).

4. In equipment for developing a waveshape and converting the waveshape to a signal in a desired frequency range, the improvement of a system for generating a composite waveshape having n possible components of different frequency in the amplitude of any sample point of the waveshape, comprising:

a first means for generating a first timing variable x;

a second means for generating a second timing variable y; and a third means for carrying out, by the use of said first and second timing variables x and y, computation of a waveshape F(x, y) in accordance with the equation:

$$F(x, y) = \frac{\cos\{x + \frac{n-1}{2} y\} \cdot \sin \frac{n}{2} y}{\sin \frac{1}{2} y}$$

wherein: n is a nonincrementing single integer greater than one, said third means including means for calculating the waveshape amplitude for each desired successive sample point of said waveshape by computing the right side of said equation only once per sample point regardless of the number or kind of said different frequency components contained in the waveshape amplitude at any sample point.

5. A waveshape generating system according to claim 4, wherein:

said first means comprises:

means for generating a first constant $\omega_1$, and means for accumulating, at certain constant intervals, said first constant $\omega_1$ to form said first timing variable x, and wherein:

said second means comprises:

means for generating a second constant $\omega_2$, and means for accumulating, at certain constant intervals, said second constant $\omega_2$ to form said second timing variable y.

6. A waveshape generating system according to claim 4, wherein:

said third means comprises:

means for computing said first phase angle $\theta_1$ in accordance with the equation:

$$\theta_1 = x + (n - 1)/2\, y;$$

means for computing said second phase angle $\theta_2$ in accordance with the equation:

$$\theta_2 = n/2\, y;$$

means for computing said third phase angle $\theta_3$ in accordance with the equation:

$$\theta_3 = \tfrac{1}{2} y;$$

means for obtaining sinusoidal values $\cos\theta_1$, $\sin\theta_2$ and $\sin\theta_3$ for said first, second and third phase angles $\theta_1$, $\theta_2$ and $\theta_3$, respectively;

means for multiplying the sinusoidal value $\cos\theta_1$ by the sinusoidal value $\sin\theta_2$; and means for dividing the result of said multiplication by the sinusoidal value $\sin\theta_3$ to obtain said waveshape F(x, y).

7. In equipment for developing a waveshape and converting the waveshape to a signal in a desired frequency range, the improvement of a system for generating a composite waveshape having n possible components of different frequency in the amplitude of any sample point of the waveshape, comprising:

a first means for generating a first timing variable x;

a second means for generating a second timing variable y; and a third means for carrying out, by the use of said first and second timing variables x and y, computation of a waveshape F(x, y) in accordance with the equation:

$$F(x, y) = 2 \cdot \frac{\sin(x + \frac{n-1}{2} y) \cdot \sin \frac{n}{2} y}{\sin \frac{y}{2}} - \frac{\sin\{(x + 2\alpha) + \frac{n-1}{2}(y + 2\beta)\} \cdot \sin \frac{n}{2}(y + 2\beta)}{\sin \frac{1}{2}(y + 2\beta)} - \frac{\sin\{(x - 2\alpha) + \frac{n-1}{2}(y - 2\beta)\} \cdot \sin \frac{n}{2}(y - 2\beta)}{\sin \frac{1}{2}(y - 2\beta)}$$

wherein: $\alpha$, $\beta$ represent parameters for determining the frequency characteristic of said waveshape F(x, y), respectively; and n is a nonincrementing single integer greater than one said third means including means for calculating the waveshape amplitude for each desired successive sample point of said waveshape by computing the right side of said equation only once per sample point regardless of the number or kind of said different frequency components contained in the waveshape amplitude at any sample point.

8. A waveshape generating system according to claim 7, wherein:

said first means comprises:

means for generating a constant R, and means for accumulating, at certain constant intervals, said constant R to form said first timing variable x, and wherein:

said second means comprises:

means for dividing said first timing variable x by a predetermined constant m to form said second timing variable y.

9. A waveshape generating system according to claim 8, wherein:

said third means comprises:

means for computing a first phase angle $\theta_1$ in accordance with the equation:

$$\theta_1 = x + (n - 1)/2\, y;$$

means for computing a second phase angle $\theta_2$ in accordance with the equation:

$$\theta_2 = n/2\, y;$$

means for computing a third phase angle $\theta_3$ in accordance with the equation:

$$\theta_3 = y/2;$$

means for computing a fourth phase angle $\theta_4$ in accordance with the equation:

$$\theta_4 = (x + 2\alpha) + (n - 1)/2\,(y + 2\beta);$$

means for computing a fifth phase angle $\theta_5$ in accordance with the equation:

$$\theta_5 = n/2\,(y + 2\beta);$$

means for computing a sixth phase angle $\theta_6$ in accordance with the equation:

$$\theta_6 = \tfrac{1}{2}(y + 2\beta);$$

means for computing a seventh phase angle $\theta_7$ in accordance with the equation:

$$\theta_7 = (x - 2\alpha) + (n - 1)/2\,(y - 2\beta);$$

means for computing an eighth phase angle $\theta_8$ in accordance with the equation:

$$\theta_8 = n/2\,(y - 2\beta);$$

means for computing a ninth phase angle $\theta_9$ in accordance with the equation:

$$\theta_9 = \tfrac{1}{2}(y - 2\beta), \text{ and}$$

a fourth means for computing said waveshape F(x, y) by the use of said first through ninth phase angle $\theta_1 \sim \theta_9$.

10. A waveshape generating system according to claim 9, wherein:

said fourth means includes:

means for forming logarithmic values log $\sin\theta_1 \sim$ log $\sin\theta_9$ of sinusoidal valves for said phase angles $\theta_1 \sim \theta_9$;

means for computing logarithmic values of respective members of the computation equation of said waveshape F(x, y) by the use of the logarithmic values of said sinusoidal values;

means for converting these logarithmic values to antilogarithmic values; and means for obtaining said waveshape F(x, y) from these antilogarithmic values.

11. An electronic musical instrument, comprising:

the claim 1 system and a fourth means for converting said waveshape F(x, y) to a musical tone corresponding to this waveshape F(x, y).

12. An electronic musical instrument according to claim 11, wherein:

the computation by said third means is carried out time-slottedly in digital representations, and wherein: said fourth means comprises:

a sound-producing system; and a digital-to-analog converter for receiving said waveshape F(x, y) and supplying, to said sound-producing system, an analog signal corresponding to said waveshape F(x, y).

13. An electronic musical instrument, comprising:

the claim 4 generating system and a fourth means for converting said waveshape F(x, y) to a musical tone corresponding to this waveshape F(x, y).

14. An electronic musical instrument according to claim 13, wherein:

the computation by said third means is carried out time-slottedly in digital representations, and wherein: said fourth means comprises:

a sound-producing system; and a digital-to-analog converter for receiving said waveshape F(x, y) and supplying, to said sound-producing system, an analog signal corresponding to this waveshape F(x, y).

15. An electronic musical instrument, comprising:

a first means for generating a first timing variable x;

a second means for generating a second timing variable y;

a third means for carrying out, by the use of said first and second timing variables x and y, computation of a waveshape F(x, y) in accordance with the equation:

$$F(x, y) = 2 \cdot \frac{\sin(x + \frac{n-1}{2} y) \cdot \sin \frac{n}{2} y}{\sin \frac{y}{2}} - \frac{\sin\{(x + 2\alpha) + \frac{n-1}{2}(y + 2\beta)\} \cdot \sin \frac{n}{2}(y + 2\beta)}{\sin \frac{1}{2}(y + 2\beta)} - \frac{\sin\{(x - 2\alpha) + \frac{n-1}{2}(y - 2\beta)\} \cdot \sin \frac{n}{2}(y - 2\beta)}{\sin \frac{1}{2}(y - 2\beta)}$$

wherein $\alpha$, $\beta$ represent parameters for determining the frequency characteristic of the waveshape F(x, y), respectively; and n is a nonincrementing single integer greater than one and is the possible number of different frequency components in the amplitude of any sample point of said waveshape;

said third means including means for calculating the amplitude of said waveshape for each desired successive sample point of said waveshape by computing the right side of said equation only once per sample point regardless of the number or kind of said components in the waveshape amplitude at any sample point; and a fourth means for converting said waveshape F(x, y) to a musical tone corresponding to this waveshape F(x, y).

16. An electronic musical instrument according to claim 15, wherein:

the computation by said third means is carried out time-slottedly in digital representations, and wherein: said fourth means comprises:

a sound-producing system; and a digital-to-analog converter for receiving said waveshape F(x, y) and supplying, to said sound-producing system, an analog signal corresponding to this waveshape F(x, y).

17. An electronic musical instrument, comprising:

a first means for generating a first timing variable x;

a second means for generating a second timing variable y;

a third means for generating a third timing variable A;

a fourth means for carrying out, by the use of said first, second and third timing variables x, y and A, computation of a waveshape F(x, y) in accordance with the equation:

$$F(x, y) = A[2 \cdot \frac{\sin(x + \frac{n-1}{2} y) \cdot \sin \frac{n}{2} y}{\sin \frac{y}{2}} - \frac{\sin\{(x + 2\alpha) + \frac{n-1}{2}(y + 2\beta)\} \cdot \sin \frac{n}{2}(y + 2\beta)}{\sin \frac{1}{2}(y + 2\beta)} - \frac{\sin\{(x - 2\alpha) + \frac{n-1}{2}(y - 2\beta)\} \cdot \sin \frac{n}{2}(y - 2\beta)}{\sin \frac{1}{2}(y - 2\beta)}]$$

wherein: $\alpha$, $\beta$ represent parameters for determining the frequency characteristic of the waveshape F(x, y), respectively; and n is a nonincrementing single integer greater than one and is the possible number of different frequency components in the amplitude of any sample point of said waveshape;

said fourth means including means for calculating the amplitude of said waveshape for each desired successive sample point of said waveshape by computing the right side of said equation only once per sample point regardless of the number of kind of said components in the waveshape amplitude at any sample point; and a fifth means for converting said waveshape F(x, y) to a musical tone corresponding to this waveshape F(x, y).

18. An electronic musical instrument according to claim 17, wherein:

the computation by said fourth means is carried out time-slottedly in digital representations and wherein: said fifth means comprises:

a sound-producing system; and a digital-to-analog converter for receiving said waveshape F(x, y) and supplying, to said sound-producing system, an analog signal corresponding to this waveshape F(x, y).

* * * * *